US006508922B2

(12) United States Patent
Kimpel et al.

(10) Patent No.: US 6,508,922 B2
(45) Date of Patent: Jan. 21, 2003

(54) PROCESS FOR MULTI-LAYER COATING

(75) Inventors: Matthias Kimpel, Schwelm (DE); Martin Wulf, Wuppertal (DE); Oliver Reis, Witten (DE)

(73) Assignee: E. I. du Pont de Nemours and Company, Wilmington, DE (US)

( * ) Notice: Subject to any disclaimer, the term of this patent is extended or adjusted under 35 U.S.C. 154(b) by 83 days.

(21) Appl. No.: 09/852,379

(22) Filed: May 10, 2001

(65) Prior Publication Data

US 2002/0166770 A1 Nov. 14, 2002

(51) Int. Cl.[7] ..... C25D 13/12
(52) U.S. Cl. ..... 204/488; 204/484; 204/509
(58) Field of Search ..... 204/484, 488, 204/509

(56) References Cited

U.S. PATENT DOCUMENTS

| | | | | |
|---|---|---|---|---|
| 3,674,671 A | | 7/1972 | Stromberg | |
| 4,882,090 A | | 11/1989 | Batzill et al. | |
| 4,988,420 A | | 1/1991 | Batzill et al. | |
| 5,275,707 A | | 1/1994 | Yamada et al. | |
| 5,882,734 A | | 3/1999 | Blum et al. | |
| 5,908,667 A | | 6/1999 | Blum et al. | |
| 6,113,764 A | * | 9/2000 | Emch | 204/509 |
| 6,350,359 B1 | * | 2/2002 | Doebler et al. | 204/488 |

FOREIGN PATENT DOCUMENTS

GB 2129807 A 5/1984

* cited by examiner

*Primary Examiner*—Kishor Mayekar
(74) *Attorney, Agent, or Firm*—Steven C. Benjamin

(57) ABSTRACT

A process for the production of a multi-layer coating, wherein a primer layer which is electrically conductive in the at least partially cured state is applied by electrodeposition from an electrodeposition coating agent (I) to an electrically conductive three-dimensional object, at least partially cured exclusively by the action of near infra-red radiation substantially only on the surfaces of the object exposed to the radiation, and an additional coating layer is applied by electrodeposition from an electrodeposition coating agent (II) which is different from electrodeposition coating agent (I), and then this additional coating layer as well as completely uncured or incompletely cured area parts of the primer layer produced from electrodeposition coating agent (I) are cured.

19 Claims, No Drawings

PROCESS FOR MULTI-LAYER COATING

FIELD OF THE INVENTION

The invention relates to a process for the production of a two-layer electrodeposition coating on three-dimensional electrically conductive objects.

BACKGROUND OF THE INVENTION

The production of two-layer electrodeposition coatings is known in the prior art. For example, multi-layer coatings composed of a two-layer electrodeposition coating which is overcoated with a clear coat or a base coat/clear coat layer are known from U.S. Pat. Nos. 5,908,667 and 5,882,734.

In the conventional production of two-layer electrodeposition coatings, an electrodeposition coat primer layer is initially deposited from an electrodeposition coating agent containing electrically conductive constituents on a metal substrate. After the electrodeposition coating layer has been cured by stoving (baking), the latter is sufficiently electrically conductive for a second electrodeposition coating layer to be deposited on it electrophoretically from a second electrodeposition coating agent and likewise stoved (baked). Overcoating with further coating layers may then take place.

This invention further develops the coating process of the prior art for coating three-dimensional objects having surface regions that are visible and not visible to the observer and saves electrodeposition coating agent and simplifies the coating process.

SUMMARY OF THE INVENTION

The invention relates to a process for the production of a multi-layer coating in which a primer layer that is electrically conductive in the at least partially cured state is applied by electrodeposition from an electrodeposition coating agent (I) to an electrically conductive three-dimensional object, at least partially cured exclusively by the action of near infrared radiation substantially only on the surfaces of the object exposed to the radiation, and an additional coating layer is applied by electrodeposition from an electrodeposition coating agent (II) that is different from electrodeposition coating agent (I), and then this additional coating layer as well as completely uncured or incompletely cured area parts of the primer layer produced from electrodeposition coating agent (I) are cured.

DETAILED DESCRIPTION OF THE EMBODIMENTS

In the description and claims, the phrase "at least partial curing" is used. "At least partial curing" means "partial curing" or preferably "complete curing". "Partial curing" means a minimum degree of curing of the electrodeposition coat primer layer that leads to a volume resistivity that is sufficiently low, for example, from $10^3$ to $10^8$ Ohm·cm, for the electrophoretic deposition of a further coating layer from an electrodeposition coating agent. In connection with the present invention, "partial curing" expressly does not mean degrees of curing of the electrodeposition coat primer layer that do not lead to a volume resistivity that is sufficiently low for the electrophoretic deposition of an additional coating layer from an electrodeposition coating agent; rather, the term "insufficient curing" is used in that case in order to make a clear distinction.

The application of the primer layer applied from electrodeposition coating agent (I) may take place in operating steps repeated several times, for example, up to three times in succession, a fresh electrodeposition coating from electrodeposition coating agent (I) taking place after exposure to near infra-red irradiation (NIR irradiation) in each case. In so doing, a multiple deposition of an electrodeposition coating layer from electrodeposition coating agent (I) may be obtained only on area parts of the coating layer(s) produced from electrodeposition coating agent (I) that have been at least partially cured by NIR irradiation, whereas completely uncured or insufficiently cured parts of the surface do not undergo multiple coating from electrodeposition coating agent (I). An electrodeposition coat-primed object having a layer thickness of the electrodeposition coat primer that is greater at least on the visible surfaces of the object than on the non-visible or not immediately visible surfaces of the object may thus be obtained.

The embodiment of the process according to the invention in which the electrodeposition coat primer layer is applied by only a single electrodeposition from electrodeposition coating agent (I) is preferred. This is a process for the production of a multi-layer coating in which a primer layer that is electrically conductive in the at least partially cured state is applied by electrodeposition from an electrodeposition coating agent (I) to the entire surface of an electrically conductive three-dimensional object. This electrodeposited primer layer is at least partially cured exclusively by the action of near infra-red radiation substantially only on the surfaces (visible surfaces) of the object exposed to the radiation, then a second coating layer is applied by electrodeposition from an electrodeposition coating agent (II), which is different from electrodeposition coating agent (I), and then the second coating layer as well as completely uncured or incompletely cured area parts of the electrodeposition coat primer layer are cured.

In the process according to the invention, electrodeposition coating agents (I) and (II) that are inherently known but different from one another are used. In both cases, they may be electrodeposition coating agents that can be deposited anodically or cathodically. Electrodeposition coating agent (I) contains constituents that provide the primer layer, in the at least partially cured state, a volume resistivity that is sufficiently low for the electrodeposition of a further coating layer from an electrodeposition coating agent.

Electrodeposition coating agents (I) and (II) are waterborne coating agents with a solids content of, for example, 10 wt. % to 30 wt. %. The solids are composed of resin solids, at least in the case of electrodeposition coating agent (I), also of electrically conductive constituents and optionally fillers, pigments and conventional non-volatile paint additives. The resin solids themselves are composed of one or more conventional binders, at least a part of the binders carrying ionic substituents and/or substituents that can be converted to ionic groups, and groups capable of chemical crosslinking. The binders having groups capable of chemical crosslinking may be self-crosslinking binders or they may be externally crosslinking binders. In the case of externally crosslinking binders, they are used in combination with crosslinking agents.

For example, conventional anodically electrodepositable (AED) coating agents may be used as electrodeposition coating agent (I) and/or (II). AED coating agents contain, for example, binders based on polyesters, epoxy resin esters, (meth)acrylic copolymer resins, maleinate oils or polybutadiene oils with a weight-average molecular mass (Mw) of, for example, 300 to 10,000 and an acid value from 35 to 300 mg KOH/g. The binders carry —COOH, —$SO_3H$ and/or —$PO_3H_2$-groups and, after neutralization of at least a part of the acid groups with bases, particularly amines, may be converted to the aqueous phase. The binders may be self-crosslinking or externally crosslinking. The AED coating agents may therefore also contain conventional crosslinking agents, e.g., triazine resins, crosslinking agents containing groups capable of transesterification, or blocked polyisocyanates.

The conventional cathodically electrodepositable (CED) coating agents based on CED binders may also be used as electrodeposition coating agent (I) and/or (II). The CED binders contain one or more cationic or basic groups, for example, primary, secondary and/or tertiary amino and/or ammonium, e.g., quaternary ammonium, phosphonium and/or sulfonium groups. The CED binders have, for example, amine values from 20 to 250 mg KOH/g and weight-average molecular masses (Mw) of preferably 300 to 10,000. Neutralizing agents used for the CED binders are the conventional acids for CED coating agents, such as, formic acid, acetic acid, lactic acid, methanesulfonic acid. Examples of CED binders include aminoepoxy resins, aminoepoxy resins with terminal double bonds, aminoepoxy resins with primary OH groups, aminopolyurethane resins, amino group-containing polybutadiene resins or modified epoxy resin carbon dioxide amine reaction products, and amino(meth) acrylate resins. The CED binders may be self-crosslinking or they may be used in mixture with well known crosslinking agents. Examples of such crosslinking agents include aminoplastic resins, blocked polyisocyanates, crosslinking agents with terminal double bonds, polyepoxy compounds or crosslinking agents containing groups capable of transesterification.

Electrodeposition coating agent (I) contains one or more electrically conductive constituents. They confer on the electrodeposition coating layer in the at least partially cured state deposited from electrodeposition coating agent (I) a volume resistivity, which is sufficiently low, for example, from $10^3$ to $10^8$ Ohm·cm, for the electrophoretic deposition of a further coating layer from an electrodeposition coating agent. Examples of such constituents are particulate inorganic or organic electrical conductors or semi-conductors, such as, black iron oxide, graphite, conductive carbon black, metal powder, e.g., of aluminum, copper or refined steel, molybdenum disulfide or electrically conductive polymers, such as, e.g., preferably polyaniline. Examples of electrodeposition coating agents containing such constituents which may be used as electrodeposition coating agent (I) can be found in U.S. Pat. No. 3,674,671; GB 2,129,807; U.S. Pat. Nos. 4,882,090; 4,988,420 and 5,275,707. The electrically conductive constituents are contained in electrodeposition coating agent (I) in a quantity such as to obtain the sufficiently low volume resistivity of the primer layer in the at least partially cured state deposited therefrom. Based on the solids content of electrodeposition coating agent (I), the proportion of electrically conductive constituent(s) is, for example, from 0.5 to 30 wt. %. The proportion may be determined easily by the skilled person; it depends, for example, on the specific gravity, the specific electrical conductivity and the particle size of the electrically conductive constituents used.

In addition to the binders and optionally present crosslinking agents and the electrically conductive constituents contained necessarily in electrodeposition coating agent (I) and optionally, in electrodeposition coating agent (II), electrodeposition coating agents (I) and (II) may contain color- and/or special effect-imparting pigments, fillers, and/or conventional paint additives, in each case in conventional quantity proportions for electrodeposition coating agents.

The pigment plus filler/binder plus crosslinking agent weight ratio of electrodeposition coating agents (I) and (II) is, for example, 0:1 to 0.8:1; it should be borne in mind here that the electrically conductive constituents in electrodeposition coating agent (I) in the context of the present invention are not considered as belonging to the group of pigments and fillers. Examples of pigments and fillers include conventional inorganic and/or organic colored pigments and/or special-effect pigments such as, titanium dioxide, iron oxide pigments, carbon black, phthalocyanine pigments, quinacridone pigments, metallic pigments, e.g. of aluminum, interference pigments, such as, titanium dioxide-coated aluminum, coated mica, iron oxide in flake form, copper phthalocyanine pigments in flake form, kaolin, talc or silica.

Electrodeposition coating agents (I) and (II) may contain additives, for example, in quantity proportions from 0.1 wt. % to 5 wt. %, based on the resin solids. Examples of additives include wetting agents, neutralizing agents, leveling agents, catalysts, corrosion inhibitors, anti-foaming agents, organic solvents, light stabilizers and antioxidants.

The objects coated in the process according to the invention are electrically conductive, three-dimensional objects with surface regions which are visible and not visible to the observer. Examples include electrically conductive polymer substrates, substrates constructed on a composite basis from electrically conductive polymer substrates and metals, and in particular metal substrates, for example, automotive bodies or parts thereof, truck chassis, agricultural machines, household appliance housings but also small bulk goods with visible and non visible surface regions. Visible surfaces are, in particular, immediately visible surfaces. Examples of visible surfaces of an automotive body include, in particular, its immediately visible outer skin and also visible interior surfaces, for example, surfaces that are visible when the doors are opened, such as, sills. Non visible or not immediately visible surface regions include interior surfaces, for example, of hollow areas, and also other surfaces that are not directly accessible. Examples of non visible or not immediately visible surfaces of an automotive body include surfaces in the interior of an automotive body, for example, motor space, passenger space or trunk, interior surfaces of hollow areas and the outward facing surface of the underbody.

The electrodeposition coat primer layer is applied in the usual way by electrodeposition from electrodeposition coating agent (I) to the entire surface of the three-dimensional objects, adhering electrodeposition coat bath material is removed in the usual way, and at least partial curing is then carried out substantially only on the visible surfaces exclusively by the action of NIR (near infra red) radiation, i.e., only or substantially only the visible surfaces of the object are irradiated with NIR radiation. In the preferred embodiment of the process according to the invention, the dry layer thickness of the electrodeposition coat primer layer is, for example, 5 $\mu$m to 25 $\mu$m.

The NIR radiation used in the process according to the invention must not be confused with longer-wave IR radiation; rather, it is short-wave infra-red radiation in the wave length range from about 750 nm to about 1500 nm, preferably 750 nm to 1200 nm. Radiation sources for NIR radiation include, for example, conventional NIR radiation emitters which may emit radiation as a flat, linear or point source. NIR radiation emitters of this kind are available commercially (for example, from Adphos). They are, for example, high-performance halogen radiation emitters with an intensity (radiation output per unit area) of generally more than 10 kW/m$^2$ to, for example, 10 MW/m$^2$, preferably from 100 kW/m$^2$ to 800 kW/m$^2$. For example, the radiation emitters reach a radiation emitter surface temperature (coil filament temperature) of more than 2000° K, preferably more than 2800° K, particularly more than 2900° K, e.g., a temperature from 2000 to 3500° K. Suitable radiation emitters have, for example, an emission spectrum with a maximum between 750 nm and 1200 nm.

NIR irradiation may be carried out, for example, in a belt unit fitted with one or more NIR radiation emitters or with one or more NIR radiation emitters positioned in front of the three-dimensional object to be irradiated, or the object to be irradiated and/or the NIR radiation emitter(s) is(are) moved relative to one another during irradiation. For example, the object to be irradiated may be moved through an irradiation tunnel fitted with one or more NIR radiation emitters, and/or a robot fitted with one or more NIR radiation emitters may guide the NIR radiation emitter(s) over the surface to be irradiated, for example, in the manner of a silhouette-like guiding of the NIR radiation emitters.

In principle, the irradiation time, distance from the object, radiation output and/or radiation emitter surface temperature of the NIR radiation emitter may be varied during NIR irradiation. The distance between the object and NIR radiation emitter may be, for example, 2 cm to 60 cm. NIR irradiation may take place continuously or discontinuously (in cycles). The irradiation time may be, for example, from 1 to 100 seconds, preferably not more than 60 seconds. The irradiation time refers either to the duration of continuous irradiation or to the sum of the periods of different irradiation cycles. By selecting the various parameters in a controlled manner, different surface temperatures of the electrodeposition coat primer layer may be obtained, for example, surface temperatures from 100° C. to 300° C.

The various irradiation parameters, such as belt speed or irradiation time, distance from object, radiation output of the NIR radiation emitter used, may be adapted by the skilled person according to the requirements of the coating task in question.

In contrast to a conventional curing of the electrodeposition coat primer layer by stoving (baking at an elevated temperature) with convection and/or irradiation with conventional longer-wave IR radiation, the NIR radiation acting only for a short period and only or substantially only on the visible object surfaces does not permit partial or full curing of the electrodeposition coat primer layer on the entire surface of the three-dimensional object. Rather, an object provided with an at least partially cured electrodeposition coat primer on the visible surfaces is obtained, whilst the electrodeposition coat primer layer on the non visible or not immediately visible surfaces of the object may be at least partially cured over area parts but is completely uncured or insufficiently cured over a substantial proportion of its area. Depending on the object geometry and circumstances during NIR irradiation, the completely uncured or insufficiently cured proportion of the area may account for, for example, 10% to 80% of the electrodeposition coat primer covering the entire object surface. Only the parts of the surface provided with an at least partially cured electrodeposition coat primer layer have a sufficiently low volume resistivity and can subsequently be coated with electrodeposition coating agent (II). Compared with the procedure characterized by conventional curing, savings can therefore be made on electrodeposition coating agent, particularly electrodeposition coating agent (II), in the process according to the invention.

As a result of the procedure according to the invention, a coating covering the entire object surface with the electrodeposition coating layer applied from electrodeposition coating agent (II) may be avoided. If it is desired to carry this out during the conventional production of two-layer electrodeposition coatings, this can be achieved by means of process measures during the electrodeposition of the second electrodeposition coat layer and/or by means of a special formulation of the second electrodeposition coating agent. These restrictive means, however, need not be used with the process according to the invention.

In the process according to the invention, in contrast to the process of the prior art, no stoving (baking) oven is required for the separate curing of the electrodeposition coat primer layer.

The three-dimensional object provided with the electrodeposition coat primer layer does not become as hot on the whole during NIR irradiation as it does with conventional curing. The cooling time prior to further electrodeposition of coating from electrodeposition coating agent (II) is reduced in the process according to the invention compared with the conventional process. This permits an increase in productivity, particularly with the two-layer electrodeposition coating of objects that require a long cooling period after conventional stoving (baking).

After completion of the final or, in the preferred embodiment of the process of the invention, the sole NIR irradiation step, further coating is carried out with electrodeposition coating agent (II). The second electrodeposition coating layer is electrodeposited in the usual way in a dry layer thickness of, for example, 10 $\mu$m to 45 $\mu$m, preferably from 15 $\mu$m to 30 $\mu$m, and then cured. Curing of the second electrodeposition coating layer may take place in a similar way to the electrodeposition coat primer by means of NIR irradiation, but in that case entails a subsequent additional stoving (baking) step in order to cure hitherto uncured or incompletely cured area parts of the electrodeposition coat primer layer, and optionally uncured or incompletely cured area parts of the second electrodeposition coating layer. Curing therefore takes place, preferably by stoving (baking), with convection and/or IR irradiation, for example, at object temperatures from 130° C. to 180° C. In so doing, hitherto uncured or incompletely cured area parts of the electrodeposition coat primer layer are cured in one process step together with the second electrodeposition coating layer.

As a result of the procedure according to the invention, a three-dimensional object is obtained with an electrodeposition coat primer covering the entire object surface and a second electrodeposition coating layer not extending over the entire object surface, i.e., applied only or substantially only to the visible surfaces.

If the coating layer applied from electrodeposition coating agent (II) is not an external clear coat or top coat layer, at least one further coating layer may be applied. Optionally, this may take place in the wet-in-wet process, i.e. before stoving (baking) of the electrodeposition coating layer applied from electrodeposition coating agent (II). The application of the at least one further coating layer takes place, preferably only or substantially only, on surface regions visible to the observer. For example, the coating layer applied from electrodeposition coating agent (II) may act as the color shade-determining base coat layer and may be overcoated with a clear coat layer, or it may act as the primer surfacer layer and be overcoated with a top coat layer or a base coat/clear coat two-layer coating.

The process according to the invention makes it possible to carry out the two-layer electrodeposition coating inherently well known for coating three-dimensional substrates with the smallest possible consumption of electrodeposition coating agent, particularly electrodeposition coating agent used for the production of the second electrodeposition coating layer. Moreover, a procedure with increased productivity compared with the prior art may be achieved due to the possibility of coating with the second electrodeposition coating agent after a shorter cooling period.

What is claimed is:

1. A process for the production of a multi-layer coating on the surfaces of an electrically conductive three dimensional object comprising the following steps:

(1) applying at least one primer layer to the surfaces of the object by electrodeposition from an electrodeposition coating agent (I);

(2) at least partially curing exclusively by the action of near infra-red radiation substantially only the primer layer on the surfaces of the object exposed to said radiation to form a primer layer that is electrically conductive in the at least partially cured state;

(3) applying an additional layer of coating by electrodeposition from an electrodeposition coating agent (II) which is different from electrodeposition coating agent (I) over the primer layer applied in step (1) that is at least partially cured; and (4) curing both the primer layer and the additional layer on the object to form the multilayer coating on the object.

2. The process of claim 1 wherein more than one primer layer is applied to the surfaces of the object by electrodeposition and each layer is at least partially cured exclusively with near infra-red radiation after application of the primer layer.

3. The process of claim 1 wherein prior to curing the primer and the additional layer in step (4) at least one additional layer of coating is applied.

4. The process of claim 1 wherein after curing the primer and the additional layer in step (4) at least one additional layer is applied.

5. The process of claim 1 wherein curing of the primer and the additional layer in step (4) is accomplished by baking at an elevated temperature.

6. The process of claim 1 wherein the electrodeposition coating agents (I) and (II) are different from one another and are individually selected from the group consisting of anodically electrodepositable coating agents and cathodically electrodepositable coating agents.

7. The process of claim 1 wherein the primer layer from electrodeposition coating agent (I) in the at least partially cured state has a volume resistivity from $10^3$ to $10^8$ Ohm·cm.

8. The process of claim 1 where the three dimensional objects have visible and non visible surface regions and are selected from the group consisting of automotive bodies, automotive body parts, truck chassis, agricultural machines, household appliance housings and small bulk goods.

9. The process of claim 1 wherein the near infra-red radiation is infra-red radiation in the wave length range from 750 nm to 1500 nm.

10. The process of claim 1 wherein the near infra-red radiation is provided by near infra-red radiation emitters with an intensity of more than 10 $kW/m^2$ to 10 $MW/m^2$.

11. A process for the production of a multi-layer coating on the surfaces of an electrically conductive three dimensional object comprising the following steps:

(1) applying a primer layer to the entire surface of the object by a single electrodeposition from an electrodeposition coating agent (I);

(2) at least partially curing exclusively by the action of near infra-red radiation substantially only the primer layer on the surfaces of the object exposed to said radiation to form a primer layer that is electrically conductive in the at least partially cured state;

(3) applying a second layer of coating by electrodeposition from an electrodeposition coating agent (II) which is different from electrodeposition coating agent (I) over the primer layer applied in step (1) that is at least partially cured; and (4) curing both the primer layer and second layer on the object to form the multilayer coating on the object.

12. The process of claim 11 wherein prior to curing the primer and second layer in step (4) at least one additional layer of coating is applied.

13. The process of claim 11 wherein after curing the primer and second layer in step (4) at least one additional layer is applied.

14. The process of claim 11 wherein curing of the primer and second layer in step (4) is accomplished by baking at an elevated temperature.

15. The process of claim 11 wherein the electrodeposition coating agents (I) and (II) are different from one another and are individually selected from the group consisting of anodically electrodepositable coating agents and cathodically electrodepositable coating agents.

16. The process of claim 11 wherein the primer layer from electrodeposition coating agent (I) in the at least partially cured state has a volume resistivity from $10^3$ to $10^8$ Ohm·cm.

17. The process of claim 11 where the three dimensional objects have visible and non visible surface regions and are selected from the group consisting of automotive bodies, automotive body parts, truck chassis, agricultural machines, household appliance housings and small bulk goods.

18. The process of claim 11 wherein the near infra-red radiation is infra-red radiation in the wave length range from 750 nm to 1500 nm.

19. The process of claim 11 wherein the near infra-red radiation is provided by near infra-red radiation emitters with an intensity of more than 10 $kW/m^2$ to 10 $MW/m^2$.

* * * * *